United States Patent [19]

Hotta et al.

[11] Patent Number: 4,541,830

[45] Date of Patent: Sep. 17, 1985

[54] DYE TRANSFER SHEETS FOR HEAT-SENSITIVE RECORDING

[75] Inventors: Shu Hotta, Hirakata; Tokihiko Shimizu, Takatsuki; Nobuyoshi Taguchi, Ikoma, all of Japan

[73] Assignee: Matsushita Electric Industrial Co., Ltd., Japan

[21] Appl. No.: 550,623

[22] Filed: Nov. 10, 1983

[30] Foreign Application Priority Data

| | | | |
|---|---|---|---|
| Nov. 11, 1982 | [JP] | Japan | 57-198715 |
| Nov. 11, 1982 | [JP] | Japan | 57-198716 |
| Dec. 1, 1982 | [JP] | Japan | 57-210767 |
| Dec. 1, 1982 | [JP] | Japan | 57-210768 |
| Jan. 18, 1983 | [JP] | Japan | 58-6310 |

[51] Int. Cl.[4] ..... B41M 5/22

[52] U.S. Cl. ..... 8/471; 428/143; 428/207; 428/323; 428/409; 428/913; 428/914

[58] Field of Search ..... 8/470, 471; 346/135.1; 428/207, 323, 913, 914, 143, 409

[56] References Cited

U.S. PATENT DOCUMENTS

| | | | |
|---|---|---|---|
| 2,655,453 | 10/1953 | Sandberg | 346/207 |
| 4,123,580 | 10/1978 | Franer | 427/152 |
| 4,418,942 | 12/1983 | Hosoi et al. | 346/207 |

FOREIGN PATENT DOCUMENTS

| | | | |
|---|---|---|---|
| 0063000 | 10/1982 | European Pat. Off. | 428/207 |

*Primary Examiner*—Bruce H. Hess

*Attorney, Agent, or Firm*—Lowe, King, Price & Becker

[57] ABSTRACT

A dye transfer sheet for heat-sensitive recording is described which comprises a substrate, and a thin layer of at least one sublimable dye formed on one side of the substrate. The dye layer comprises non-sublimable particles uniformly distributed throughout the layer to form irregularities on the layer surface.

12 Claims, 8 Drawing Figures

DYE TRANSFER SHEETS FOR HEAT-SENSITIVE RECORDING

BACKGROUND OF THE INVENTION

1. Field of the Invention

This invention relates to the heat-sensitive recording and more particularly, to dye transfer materials or sheets for high speed, heat-sensitive recording.

2. Description of the Prior Art

Broadly, the principle of recording of image using dye transfer sheets is as follows. A dye transfer sheet for heat-sensitive recording comprising a sublimable dye is placed in face-to-face relation with an image-receiving sheet on which a dye image is received. These sheets are set between a heat source such as a thermal head or a laser beam, which is selectively controlled according to image information, and a platen. The dye transfer sheet is heated in an imagewise pattern by the heat source, by which the dye on the sheet is selectively transferred on the image-receiving sheet to form an intended image thereon.

Heat transfer materials for full color recording which comprise sublimable dyes and are suitable for high speed recording are now widely used. However, these materials involve the problem that the recorded images obtained using the materials are disturbed in quality thereof especially in the half tone region. This results chiefly from dropouts of recording in portions to which an energy is applied and from the sublimation or scattering (i.e. noises) of dye in portions to which no energy is applied.

SUMMARY OF THE INVENTION

It is an object of the present invention to provide dye transfer sheets for heat-sensitive recording which are suitable for high speed recording by electronic devices, for example, a thermal head and a laser beam.

It is another object of the invention to provide dye transfer sheets which are reduced in dropout and noise especially in the half tone region and can thus yield recorded images of good quality.

It is a further object of the invention to provide dye transfer sheets which can provide black images of high quality over a wide range of recording density.

The dye transfer sheet for heat-sensitive recording according to the present invention comprises a substrate, and a thin layer of at least one sublimable dye formed on one side of the substrate and containing non-sublimable particles uniformly distributed throughout the layer to form irregularities on the layer surface.

DETAILED DESCRIPTION AND PREFERRED EMBODIMENTS OF THE INVENTION

The dye transfer sheet for heat-sensitive recording according to the invention is characterized by the presence of non-sublimable particles distributed throughout a sublimable dye layer, thereby forming irregularities on the surface of the dye layer.

Figure 1:
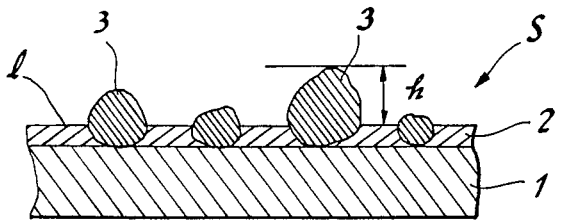
FIG. 1 is a schematic sectional view illustrating a dye transfer sheet for heat-sensitive recording according to one embodiment of the present invention.
Figure 2:
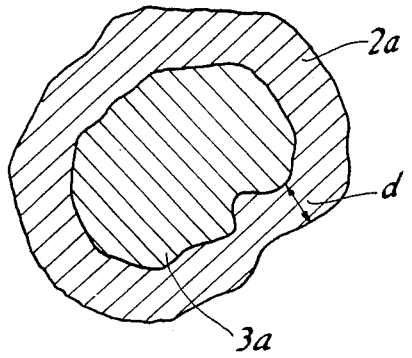
FIG. 2 is a schematic illustrative view, in section, of the relation of a non-sublimable particle and a sublimable dye layer.

Reference is now made to the accompanying drawings and particularly, to FIGS. 1 and 2. In the figures, there is shown a dye transfer sheet S which comprises a substrate 1 and a sublimable dye layer 2 formed on one side of the substrate 1. Non-sublimable particles 3 are distributed throughout the dye layer 2 so that part of the particles 3 projects from a surface level, 1, of the layer 2, thereby forming irregularities on the layer surface.

The non-sublimable particles serve to prevent the sublimable dye layer from direct contact with an image-receiving sheet or material during image transfer operation. By this, the dropouts and noises especially in the half tone region can be suitably reduced with recorded images of high quality. In order to ensure the reduction of dropouts and noises, it is preferable to distribute the non-sublimable particles in such a way that at least two adjacent particles are positioned at a distance of 200 μm or below as sectioned along the surface level of the thin layer. In other words, assuming that one non-sublimable particle 3 has a section 3*a* at the surface level of the sublimable dye layer as shown in FIG. 2, at least one adjacent particle should preferably be present as a similar section in an area 2*a* of FIG. 2. The area is defined as an area established between the outer periphery of the section 3*a* and a similar figure drawn to surround the outer periphery at a distance, d. If the distance, d, is below 200 μm, good results are obtained. Better results are obtained when the distance, d, is below 20 μm. With the distance, d, beyond 200 μm, the effect of non-sublimable particles may not be satisfactory.

In addition, when the non-sublimable particles 3 have a height, h, as shown in FIG. 1, from the surface level, 1, of the sublimable dye layer 2 in the range of 0.1 to 1000 μm, good results are obtained. Most preferably, the height, h, is in the range of 1 to 100 μm. If the height, h, is smaller than 0.1 μm, non-sublimable particles do not act effectively. On the contrary, when the height, h, exceeds 1000 μm, smooth sublimation of sublimable dye is impeded. The dye layer is very thin and is, for example, in the range of $10^{-2}$ to $10^{2}$ μm, preferably 0.1 to 10 μm. An average size of the non-sublimable particles is determined to be in the range of 0.1 to 1000 or more μm, preferably 1 to 100 μm provided that the size is larger than the layer thickness.

Figure 3:
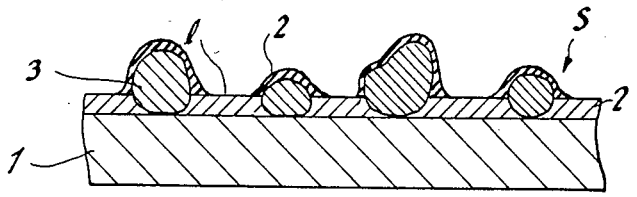
FIG. 3 is similar to FIG. 1 and shows another embodiment of the invention.

In practice, the non-sublimable particles themselves are not necessarily exposed from the sublimable dye layer but may be covered with the layer in the projected state as particularly shown in FIG. 3. Even though the particles are covered, their action is scarcely impeded. Whether or not the non-sublimable particles are fully covered with dye depends chiefly on the affinity of dye with the particles.

The dyes used in the dye transfer sheet of the invention should be sublimable upon application of heat and may be any known dyes used for these purposes. Examples of the dyes include disperse dyes, basic dyes, and dye formers of basic dyes. Typical and specific examples are particularly shown in examples appearing hereinlater and include compounds of the following formulas (a) through (m).

(a)

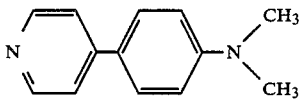

(b)

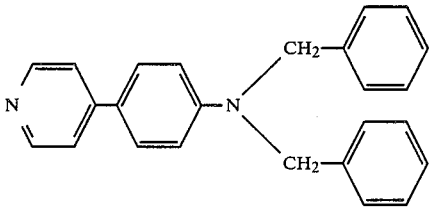

(c)

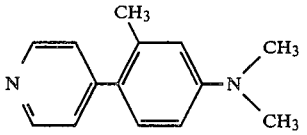

(d)

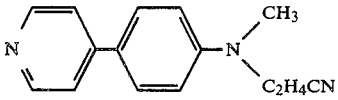

(e)

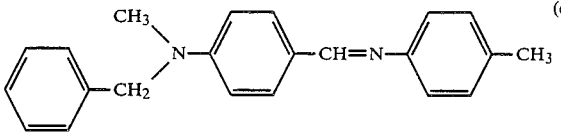

(f)

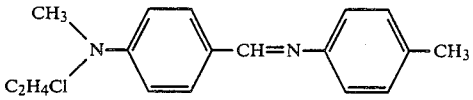

(g)

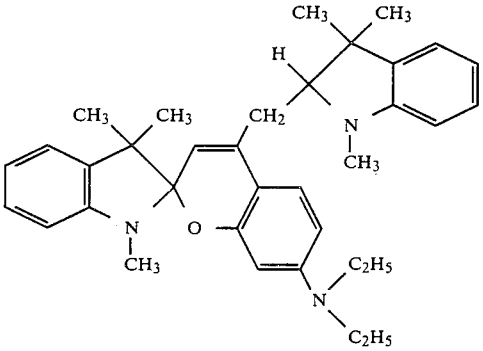

-continued (h)

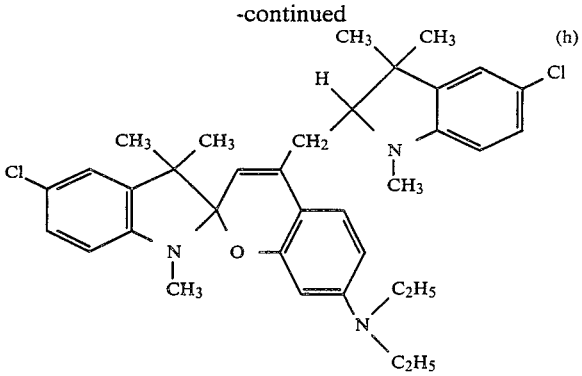

(i)

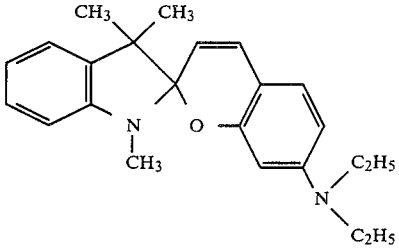

(j)

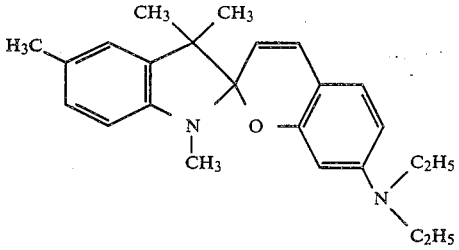

(k)

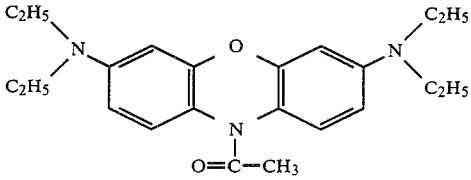

(l)

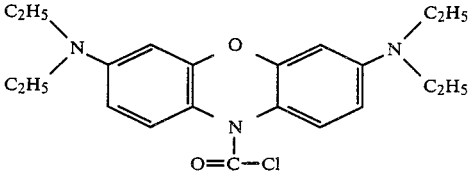

(m)

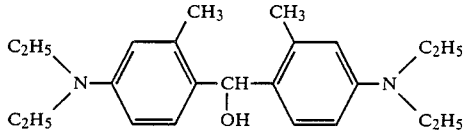

As a substrate for the dye transfer sheet, there are used a condenser paper, a cellophane sheet, films of heat-resistant resin such as polyimides, polyethylene terephthalate, polyethylene naphthalate and the like. Aside from the just-mentioned materials, there are also used films or sheets of soluble resins of melting points higher than 100° C. such as polysulfones, polycarbonates, polyphenylene oxides, cellulose derivatives, polyesters and the like. The latter resin films are advantageous especially when no binder is used in the dye layer.

This is because when a mixture of a dye and non-sublimable particles in solvent is applied on a soluble resin film, the dye layer distributing the particles therein strongly adheres to the substrate film. The sheet or film substrate for these purposes has a thickness of several to several tens um.

The non-sublimable particles are made of a variety of materials such as metals, metal oxides, metal sulfides, graphite, carbon black, silicon carbide, minerals, inorganic salts, organic pigments, or polymers or compositions thereof. Suitable examples are shown below.

Metals: aluminium, silicon, germanium, tin, copper, zinc, silver, iron, cobalt, nickel, chromium, and alloys thereof.

Metal oxides: alumina, berylium oxide, magnesium oxide, cuprous oxide, zinc oxide, indium oxide, tin oxide, titanium oxide, silicon oxide, iron oxide, cobalt oxide, nickel oxide, manganese oxide, tantalum oxide, vanadium oxide, tungsten oxide, molybdenum oxide, and mixtures thereof with or without being doped with impurities.

Metal sulfides: copper sulfide, zinc sulfide, tin sulfide, molybdenum sulfide and the like.

Minerals: magnesia minerals, lime minerals, strontium minerals, barium minerals, zirconium minerals, titanium minerals, tin minerals, phosphorus minerals, aluminium minerals such as agalmatolite, kaolin and clay, silicon minerals such as quartz, mica, talc, zeolite, diatomaceous earth.

Inorganic salts: carbonates or sulfates of alkaline earth metals such as magnesium carbonate, calcium carbonate, strontium carbonate, barium carbonate, magnesium sulfate, calcium sulfate, strontium sulfate and barium sulfate, and metal silicates.

Polymers and polymer compositions: phenolic resins, melamine resins, urethane resins, epoxy resins, silicone resins, urea resins, diallyl phthalate resins, alkyd resins, acetal resins, acrylic resins, methacrylic resins, polyester resins, cellulose resins, starch and derivatives thereof, polyvinyl chloride, polyvinylidene chloride, chlorinated polyethylene, fluorocarbon resins, polyethylene, polypropylene, polystyrene, polyvinylbenzene, polyvinylacetal, polyamides, polyvinyl alcohol, polycarbonates, polysulfones, polyether sulfones, polyphenylene oxide, polyphenylene sulfide, polyether ketones, polyaminobismaleimide, polyacrylates, polyethylene terephthalate, polyimides, polyamide-imides, polyacrylonitrile, AS resins, ABS resins, SBR resin, and compositions comprising these resins.

These materials are finely powdered to have an average size defined before and may have any forms. Preferably, the particles should be in the round or spherical form for the reason described later. The non-sublimable particles of these materials have great mechanical strengths and are not broken under a pressure exerted thereon upon intimate contact of the dye transfer sheet with an image-receiving sheet.

Aside from polymers or polymer compositions indicated above, those polymer materials or compositions which have melting or softening points higher than 100° C. are more effective. Among various sublimable dyes, there are a number of dyes which are able to sublimate at temperatures below 100° C. Polymers or polymer compositions which can satisfy the above requirement do not transfer to an image-receiving sheet and thus a transparent image of good quality made of dye alone can be obtained.

In practice, the sublimable dye and the non-sublimable particles are mixed in liquid medium to obtain a dispersion. The dispersion is, for example, cast on a substrate and dried as usual, thereby obtaining a dye transfer sheet. In order to obtain good results, non-sublimable particles are added in an amount of $10^{-2}$ to $10^{4}$ parts by volume per 100 parts by volume of a sublimable dye used. This amount depends very largely on the size of the particles.

As a matter of course, a binder may be used to form a tanacious dye layer. Examples of the binder include polysulfones, polycarbonates, polyphenylene oxides, cellulose derivatives and the like materials which are high in melting or softening point. These materials do not melt nor transfer to an image-receiving material by application of heat upon recording and can thus contribute to formation of a transparent image of high quality. If a binder is used, its amount is generally in the range of 1 to 100 parts by volume per 100 parts by volume of dye used. The binder has the following merits: it serves to retain a sufficient amount of sublimable dye in the dye layer; used of binder allows a closer distance between the surface level, 1, and an image-receiving sheet, ensuring a sufficiently high recording density on an image; and the resulting dye transfer sheet can stand repeated use. The dye layer with or without containing a binder has usually a dry thickness of $10^{-2}$ to $10^{2}$ $\mu$m, preferably 0.1 to 10 $\mu$m, as described before.

A substrate may have a prime coating thereon in which a dispersion of a sublimable dye and non-sublimable particles is applied. Subsequently, the applied sheet is heated to melt the prime coating, thereby combining the dye and the non-sublimable particles to the substrate through the prime coating. The prime coating is made, for example, of polycarbonates, polyesters and the like soluble resins as mentioned hereinbefore with regard to the substrate.

In order to obtain a black image using a dye transfer sheet to which the present invention is directed, it is general to use a plurality of sublimable dyes. However, it was very difficult to obtain a black image of good quality over a wide range of from low to high recording densities. This is because dyes are not uniformly transferred on an image-receiving sheet upon direct contact between a dye layer and the image-receiving sheet, and a dye near the image-receiving sheet is preferentially transferred. However, with a dye transfer sheet using non-sublimable particles, transfer of a plurality of dyes on an image-receiving sheet is facilitated by uniform sublimation of the respective dyes without involving preferential transfer of dyes near the image-receiving sheet. Accordingly, the individual dyes are uniformly transferred on the sheet.

In the practice of the invention, if a plurality of dyes are used, it is preferable to use at least one sublimable basic dye including a colored dye or a color former capable of forming a color in combination with an electron acceptor and at least one disperse dye. This combination is particularly suitable when used together with an image-receiving sheet of the type which contains finely powdered inorganic acidic solids such as activated clay, alumina and silica. By this combination, a black color of very good tone and high recording density is obtained. Presumably, this is because dye sites of basic and disperse dyes are different from each other, thus not causing harmful interactions on deposition and color formation of the respective dyes. As a matter of course, images of any color other than black may be suitably obtained by combination of a plurality of dyes.

Figure 4:
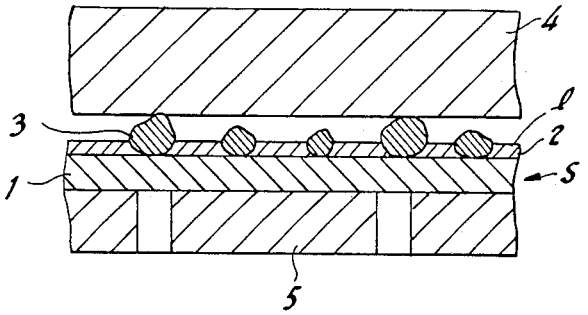
FIG. 4 is a schematic view illustrating the principle of heat-sensitive recording using the dye transfer sheet of the invention placed in a heat-sensitive recording apparatus.

The action of the non-sublimable particles 3 is illustrated with reference to FIG. 4 in which the dye transfer sheet S is placed in face-to-face relation with an image-receiving sheet 4 and heated by a thermal head 5. As a result, the dye on the sheet S is transferred by sublimation to the image-receiving sheet 4 according to information from the thermal head 5. Because the dye layer 2 does not contact directly with the image-receiving layer 5, the dye does not transfer by pressure or melting but transfers only by sublimation or vaporization, thereby giving a good transparent or colored image.

In order to obtain half tone images of good quality, it is important to uniformly distribute non-sublimable particles throughout a dye layer. The distribution density depends on the size of picture element, the smoothness and uniformity of substrate and image-receiving sheet, and the like. The non-sublimable particles serve as a spacer in a smaller distribution density when the size of picture element is larger and the smoothness or uniformity of substrate and image-receiving sheet increases.

Figure 5:
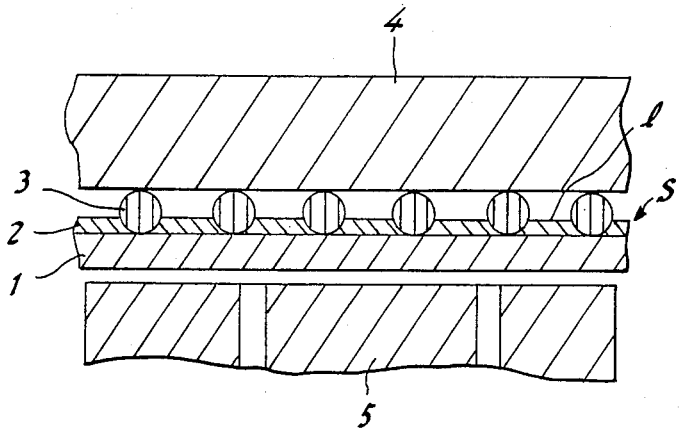
FIG. 5 is similar to FIG. 4 but substantially spherical non-sublimable particles of a uniform size are used.

As mentioned hereinbefore, the shape of non-sublimable particles is preferred to be round or spherical with a uniform size. This is because individual round particles have the function as a spacer even when distributed in any portions in the dye layer. As is particularly shown in FIG. 5, no change in distance between the substrate 1 and the image-receiving sheet 4 occurs when round particles having a uniform size are used and distributed in the dye layer 2. A great number of materials for the non-sublimable particles are indicated before. Of these, metals, metal oxides and polymer compositions are more effective because of their great rigidity or elasticity.

The present invention is more particularly described by way of example.

EXAMPLE 1

5 parts by volume of a sublimable dye represented by the structural formula (1), 5 parts by volume of polycarbonate, 100 parts by volume of dichloromethane, and different amounts of alumina particles having an average size of 3 μm were agitated in separate ball mills. The resulting dispersions were each applied on a 12 um thick condenser paper by means of a wire bar and dried, thereby obtaining a dye transfer sheet.

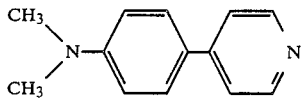

(1)

These sheets were used to form an image on an active clay-coated paper by a thermal head. Recording conditions were as follows.

Line density of main and sub scannings: 4 dots/mm
Recording power: 0.7 W/dot
Heating time of the head: 4 msec.

Figure 6:
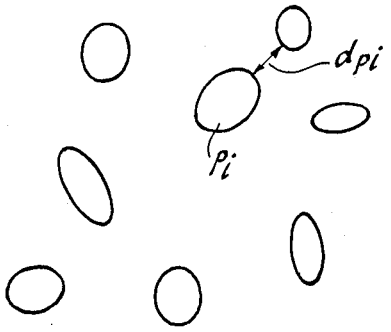
FIG. 6 is a schematic view showing the relation among non-sublimable particles.

The numbers of dropouts and noises per 1000 dots are shown in Table 1 along with a maximum length, max (dpi), among minimum distances, dpi, between an arbitrary alumina particle, Pi, and other particles present near the particle, Pi. The minimum distance, dpi, is defined as shown in FIG. 6 and was determined from a photograph of a scanner-type electron microscope taken vertically with respect to the condenser paper.

The height, h, defined with reference to FIG. 1 was determined from a photograph of a scanner-type electron microscope of a section of each dye transfer sheet. The height was found to be below 7 μm in all the sheets using different amount of the alumina particles. For comparison, a dye transfer sheet using no alumina particles was made and tested with the results shown in Table 1.

TABLE 1

| Amount of alumina (parts by vol.) | Dropouts per 1000 dots | Noises per 1000 dots | Max (dpi) (μm) |
|---|---|---|---|
| $10^{-3}$ | 39 | 103 | 172 |
| $10^{-2}$ | 31 | 47 | 76 |
| $10^{-1}$ | 19 | 19 | 24 |
| 1 | 8 | 11 | 9 |
| 10 | 9 | 7 | 3 |
| $10^{2}$ | 23 | 7 | 2 |
| Nil (comparsion) | 52 | 262 | — |

EXAMPLE 2

20 parts by weight of alumina particles having different average sizes of 0.1, 0.5, 1, 2, 3, 5, 10, 15, 20, 50, and 100 μm, 5 parts by volume of the sublimable dye used in example 1, t parts by volume of a polyester resin, and 100 parts by volume of chloroform were mixed in separate ball mills for different sizes of alumina particles. The resulting dispersions were each applied in the same manner as in Example 1 to obtain dye transfer sheets.

These sheet were used for recording in the same manner as in Example 1. The numbers of dropouts and noises per 1000 dots, the maximum length, max(dpi), and the height, h, were shown in Table 2 below.

TABLE 2

| Size of alumina (μm) | Dropouts per 1000 dots | Noises per 1000 dots | Max (dpi) (μm) | h (μm) |
|---|---|---|---|---|
| 0.1 | 39 | 131 | 0.1 | 0.1 |
| 0.5 | 21 | 45 | 0.5 | 1 |
| 1 | 14 | 31 | 1 | 2 |
| 2 | 11 | 17 | 2 | 4 |
| 3 | 9 | 10 | 6 | 5 |
| 5 | 7 | 6 | 11 | 9 |
| 10 | 10 | 5 | 23 | 15 |
| 15 | 18 | 8 | 29 | 30 |
| 20 | 19 | 11 | 38 | 37 |
| 50 | 26 | 4 | 107 | 98 |
| 100 | 42 | 3 | 180 | 207 |

From the results of the above examples, it will be seen that the recorded images obtained from the dye transfer sheets of the invention are much more reduced than the image from the comparative sheet with respect to the dropout and noise and have thus good quality. Especially when max(dpi)≦20 μm and 1 μm≦h≦100 μm, better results are obtained. This will be clearly seen in Table 2.

Similar results are obtained using non-sublimable particles other than alumina particles provided that max(dpi)≦200 μm and 0.1 μm≦h≦1000 μm.

Full color images could be obtained when three types of dye transfer sheets capable of forming cyan, magenta and yellow colors were used.

EXAMPLE 3

2 parts by volume of each of various non-sublimable particles having an average size of 3 μm, 1 part by volume of a sublimable dye represented by the formula (2), and 100 parts by weight of dichloromethane were, separately, mixed in ball mills.

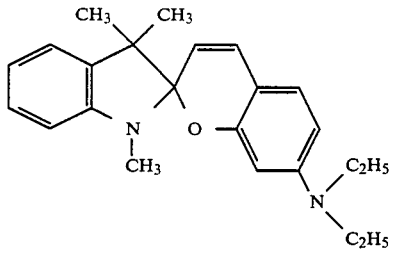

(2)

The resulting dispersions were each applied, by means of a wire bar, onto a 12 μm thick condenser paper having a 1 μm thick polycarbonate prime coating thereon, thereby obtain a dye transfer sheet. The non-sublimiable particles used were particles of copper, iron, alumina, zinc oxide, tin oxide, titanium oxide, zinc sulfide, clay, zeolite, calcium carbonate, barium sulfate, polyvinylidene fluoride, and polyphenylene sulfide.

These dye transfer sheets were each used to record an image on an active clay paper by a thermal head under recording conditions as used in Example 1.

The numbers of dropouts and noises per 1000 dots are shown in Table 3. For comparison, a dye transfer sheet using no non-sublimable particles was made and tested.

TABLE 3

| Non-sublimable particles | Dropouts per 1000 dots | Noises per 1000 dots |
|---|---|---|
| Copper | 25 | 23 |
| Iron | 14 | 36 |
| Alumina | 9 | 12 |
| Zinc oxide | 8 | 21 |
| Tin oxide | 8 | 10 |
| Titanium oxide | 20 | 16 |
| Zinc sulfide | 12 | 31 |
| Clay | 10 | 36 |
| Zeolite | 12 | 18 |
| Calcium carbonate | 13 | 18 |
| Barium sulfate | 15 | 11 |
| Polyvinylidene fluoride | 19 | 20 |
| Polyphenylene sulfide | 18 | 28 |
| Nil (comparison) | 63 | 393 |

EXAMPLE 4

2 parts by volume of each of various non-sublimable particles having an average size of 5 μm, 2 parts by volume of a sublimable dye represented by the formula (3), 4 parts by volume of polycarbonate, and 100 parts by volume of dichloromethane were mixed in a ball mill. The resulting dispersion was applied by a wire bar onto a 12 μm thick condenser paper, thereby obtaining a dye transfer sheet.

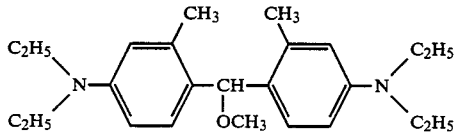

(3)

The non-sublimable particles used were particles of copper, iron, alumina, zinc oxide, in oxide, titanium oxide, zinc sulfide, clay, zeolite, calcium carbonate, barium sulfate, polyphenylene sulfide, and polyvinylidene fluoride.

These dye transfer sheets were used for recording an image on an active clay-coated paper by means of a thermal head under recording conditions as used in Example 1.

The numbers of dropouts and noises per 1000 dots are shown in Table 4.

The above procedure was repeated without use of any non-sublimable particles for comparison.

TABLE 4

| Non-sublimable particles | Dropouts per 1000 dots | Noises per 1000 dots |
|---|---|---|
| Copper | 22 | 12 |
| Iron | 13 | 18 |
| Alumina | 10 | 4 |
| Zinc oxide | 10 | 8 |
| Tin oxide | 7 | 7 |
| Titanium oxide | 16 | 15 |
| Zinc sulfide | 15 | 21 |
| Clay | 9 | 8 |
| Zeolite | 8 | 11 |
| Calcium carbonate | 13 | 12 |
| Barium sulfate | 10 | 5 |
| Polyphenylene sulfide | 23 | 8 |
| Polyvinylidene fluoride | 12 | 17 |
| Nil (comparison) | 58 | 342 |

EXAMPLE 5

2 parts by volume of dyes represented by the following formulas (4), (5) and (6), and 5 parts by volume of a polycarbonate were dissolved in 100 parts by volume of methylene chloride. To the solution was added 0.5 part by volume of spherical particles made of a divinylbenzene polymer composition and having an average size of 7 μm with a standard deviation of 0.5 μm, followed by ultrasonic dispersion. The resulting dispersion was cast on a 12 μm thick polyimide film by means of a wire bar, thereby obtaining a dye transfer sheet.

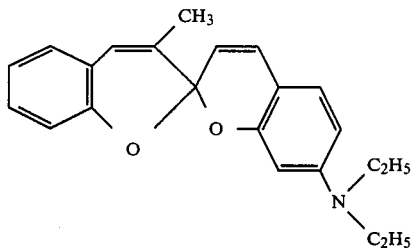

(4)

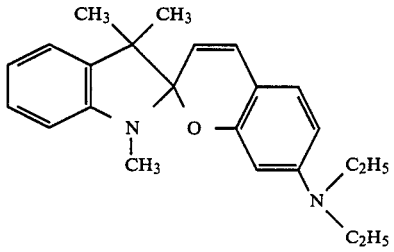

(5)

-continued

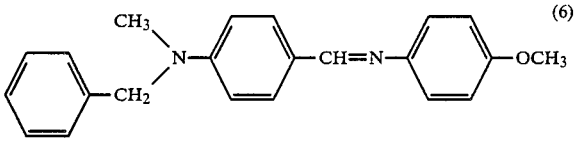

(6)

The dye transfer sheet was used for recording on a clay-coated paper by a thermal head under the following recording conditions.

Line density of main and sub scannings: 4 dots/mm

Recording power: 0.7 W/dot

Heating time of the head: 1–8 ms.

As a result, a black image of good quality was obtained in the recording density ranging from 0.15 to 1.7.

EXAMPLE 6

Figure 7:
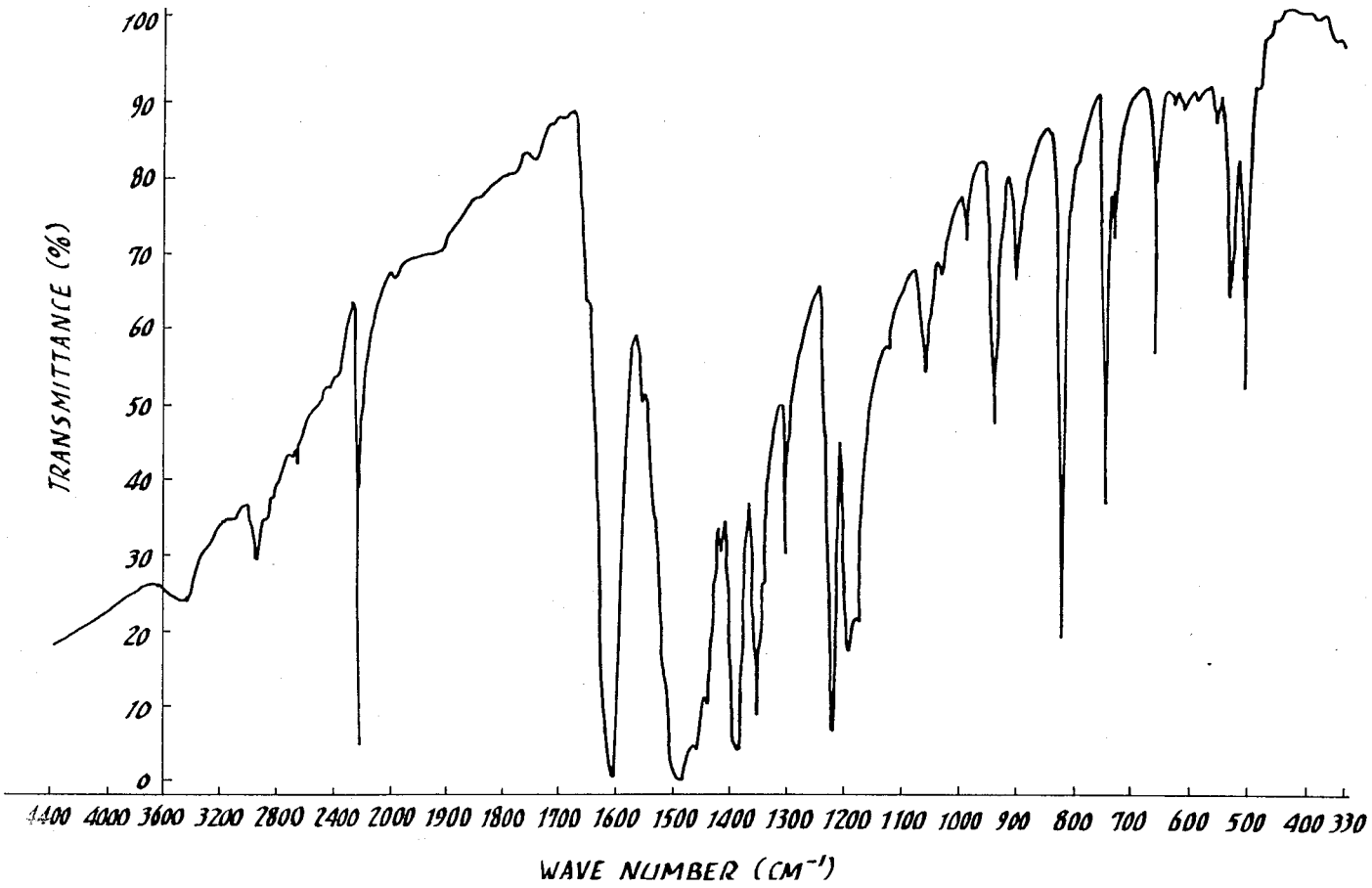
FIGS. 7 and 8 are infrared spectrum charts of disperse dyes used in Examples.
Figure 8:
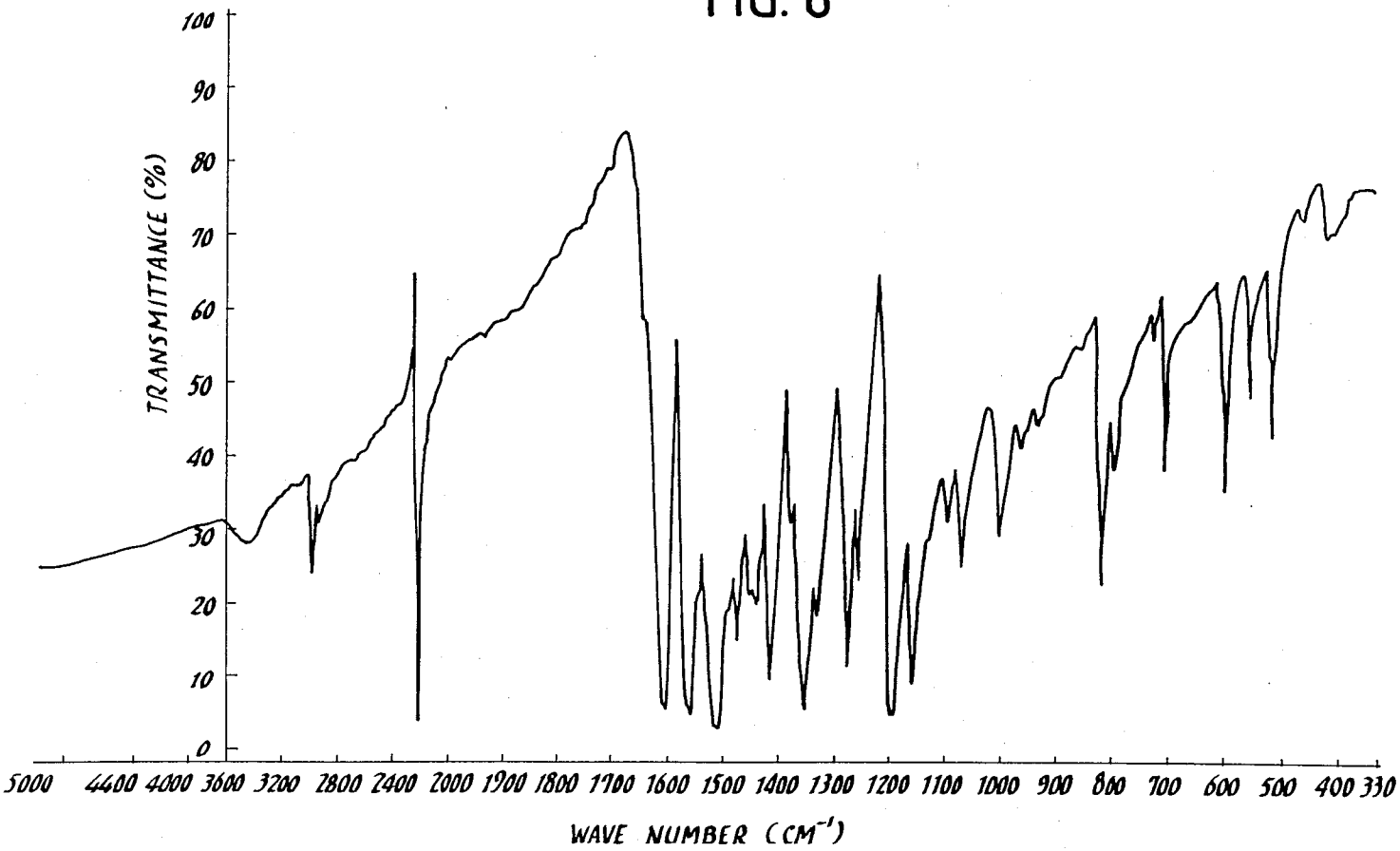

Each 2 parts by volume of a disperse dye represented by the formula (7), and disperse dyes A (C: 70.0%, H: 4.5%, N: 24.6%) and B (C: 74.1%, H: 6.5%, N: 18.3%) having infrared spectrum charts of FIGS. 7 and 8, respectively, and 5 parts by volume of polycarbonate were dissolved in 100 parts by volume of methylene chloride. To the solution was added 1.0 part by volume glass beads having an average size of 10 μm with a standard deviation of 2 μm, followed by ultrasonic dispersion. The resulting dispersion was cast on a 12 μm thick cellophane sheet by a wire bar to obtain a dye transfer sheet.

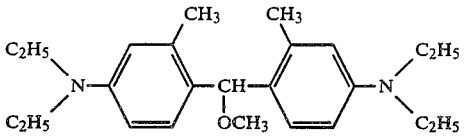

(7)

The dye transfer sheet was used for recording on a clay-coated paper under the same conditions as in Example 5. As a result, it was found that a black image of good quality could be obtained in a recording density ranging from 0.15 to 1.9.

From Examples 5 and 6, it will be appreciated that black images obtained from the dye transfer sheets of the invention have good quality over a wide range of recording density.

A number of sublimable dyes were used in the foregoing examples. Of these, the disperse dyes A and B used in Example 6 which are magenta and yellow in color, respectively, are preferred when used singly or in combination as described in Example 6 because of their higher heat sensitivity.

What is claimed is:

1. A dye transfer sheet for heat-sensitive recording comprising a substrate, and a thin layer of at least one sublimable dye formed on one side of the substrate, said thin layer containing non-sublimable particles uniformly distributed throughout the layer and projecting from the surface of the layer to form irregularities on the layer surface.

2. The dye transfer sheet according to claim 1, wherein said non-sublimable particles are distributed in such a way that at least two adjacent particles are positioned at a distance of 200 μm or below as sectioned along the surface level of said thin layer.

3. The dye transfer sheet according to claim 2, wherein the distance is below 20 μm.

4. The dye transfer sheet according to claim 2, wherein the irregularities have a height within a range of from 0.1 to 1000 μm.

5. The dye transfer sheet according to claim 1, wherein the irregularities have a height within a range of from 0.1 to 1000 μm.

6. The dye transfer sheet according to claim 1, wherein said non-sublimable particles are used in an amount of $10^{-2}$ to $10^{4}$ parts by volume per 100 parts by volume of said at least one dye.

7. The dye transfer sheet according to claim 1, wherein said non-sublimable particles are substantially in spherical form.

8. The dye transfer sheet according to claim 1, wherein said thin layer further comprises a binder.

9. The dye transfer sheet according to claim 1, wherein said is substrate made of a soluble resin of a melting point higher than 100° C.

10. The dye transfer sheet according to claim 9, wherein the plurality of sublimable dyes comprises at least one sublimable basic dye, and at least one disperse dye.

11. The dye transfer sheet according to claim 1, wherein said thin layer is made of a plurality of sublimable dyes.

12. The dye transfer sheet according to claim 1, further comprising a prime coating between said substrate and said thin layer, said prime coating being made of a soluble resin.

* * * * *